United States Patent [19]

Howard et al.

[11] Patent Number: 4,541,126

[45] Date of Patent: Sep. 17, 1985

[54] BALL GLOVE WITH FLEXIBLE WEB

[75] Inventors: John R. Howard, West Chicago; Bob Machacek, Lombard, both of Ill.

[73] Assignee: Wilson Sporting Goods Co., River Grove, Ill.

[21] Appl. No.: 604,727

[22] Filed: Apr. 27, 1984

[51] Int. Cl.[4] ..... A41D 13/10
[52] U.S. Cl. ..... 2/19
[58] Field of Search ..... 2/19, 161 A, 16, 159

[56] References Cited

U.S. PATENT DOCUMENTS

| | | | |
|---|---|---|---|
| 2,414,004 | 1/1947 | Turner | 2/19 |
| 2,475,262 | 7/1949 | Sonnett et al. | 2/19 |
| 3,321,771 | 5/1967 | Latina | 2/19 |
| 3,623,163 | 11/1971 | Latina | 2/19 |
| 4,192,018 | 3/1980 | Latina | 2/19 |

*Primary Examiner*—Werner H. Schroeder
*Assistant Examiner*—J. L. Kravitz

[57] ABSTRACT

A ball glove includes a web between the thumb and forefinger which is provided with a plurality of slits to make the web more flexible and extensible so that the web does not require breaking in.

25 Claims, 14 Drawing Figures

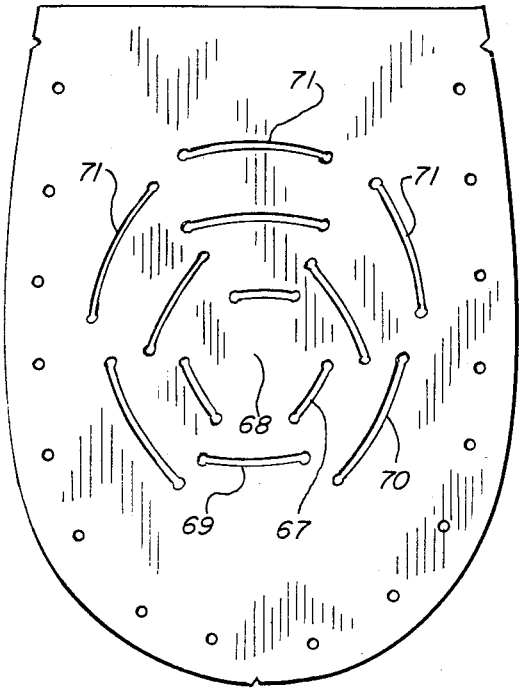
FIG. 9
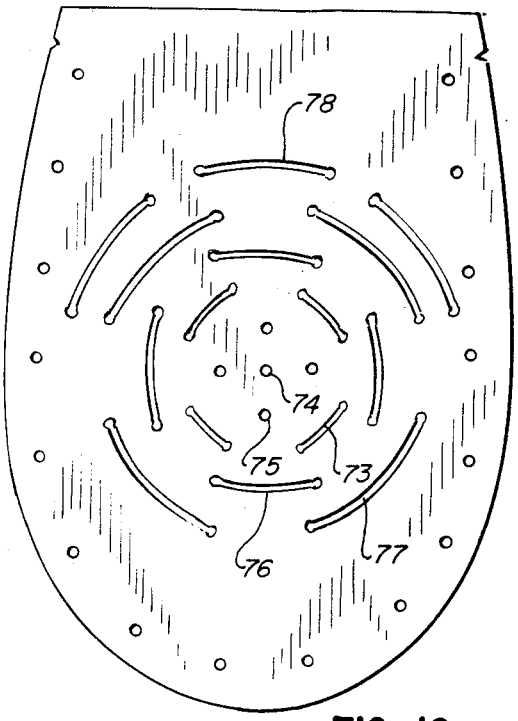
FIG. 10
FIG. 11
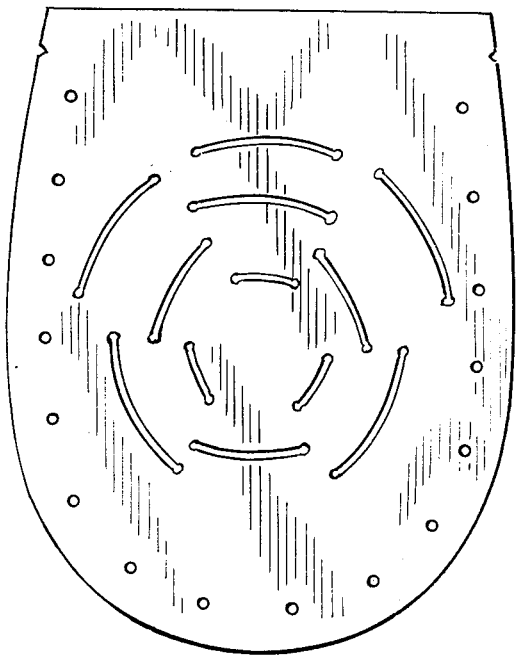

BALL GLOVE WITH FLEXIBLE WEB

BACKGROUND AND SUMMARY

This invention relates to ball gloves, and, more particularly, to a web for a ball glove such as a baseball glove which is flexible and extensible without a break-in period.

Baseball gloves conventionally include a web which extends between the thumb and forefinger of the glove. Most webs are firm and unyielding when new and do not form a natural pocket for the baseball. A new glove therefore requires a break-in period during which the glove is used to catch a ball repeatedly before the glove and the web become flexible enough and yielding enough to form a pocket for the ball when the ball is caught.

The invention provides a web which is flexible and extensible enough to form a natural pocket for the ball without a break-in period. The web is formed from sheet material, for example, leather or imitation leather, and a plurality of slits are made in the leather. The slits are preferably arranged in sets around a central or focal portion, the slits of each set being spaced different distances from the focal portion. The sheet material can be reinforced with rows of stitching between the slits of adjacent sets. The slits separate the sheet material into portions which can move with greater independence than a sheet without slits, and these portions flex and extend relative to each other when a ball is caught by the web so that the web conforms around the ball and forms a pocket for the ball.

DESCRIPTION OF THE DRAWINGS

The invention will be explained in conjunction with an illustrative embodiment shown in the accompanying drawing, in which

FIGS. 7 through 14 are plan views of alternate embodiments of the web.

DESCRIPTION OF SPECIFIC EMBODIMENTS

Figure 1:
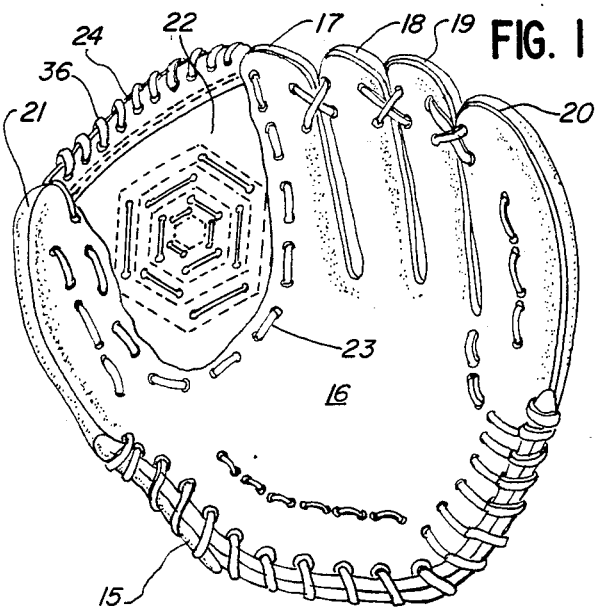
FIG. 1 is a front perspective view of a conventional baseball glove which is provided with a web formed in accordance with the invention.
Figure 2:
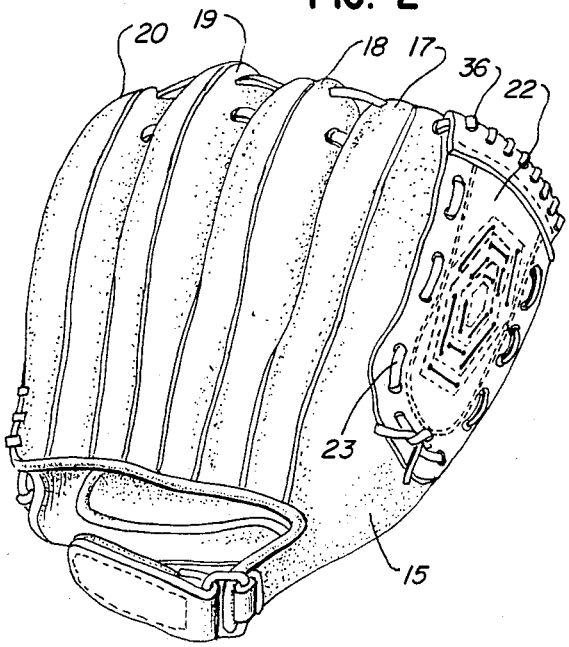
FIG. 2 is a rear perspective view of the baseball glove of FIG. 1.

Referring to FIGS. 1 and 2, a baseball glove 15 includes a palm portion 16, four finger stalls 17, 18, 19, and 20, and a thumb stall 21. A web 22 extends between the thumb stall 21 and the stall 17 for the forefinger and is secured to the stalls by lacing 23. The lacing also secures the web to the portion of the palm portion between the stalls for the thumb and forefinger so that the lacing extends generally in the form of a U.

The particular glove illustrated in the drawing is a fielder's baseball glove. However, it will be understood that the invention can be used with other types of gloves, for example, a first baseman's baseball glove, a catcher's mitt, and a softball glove.

Figure 3:
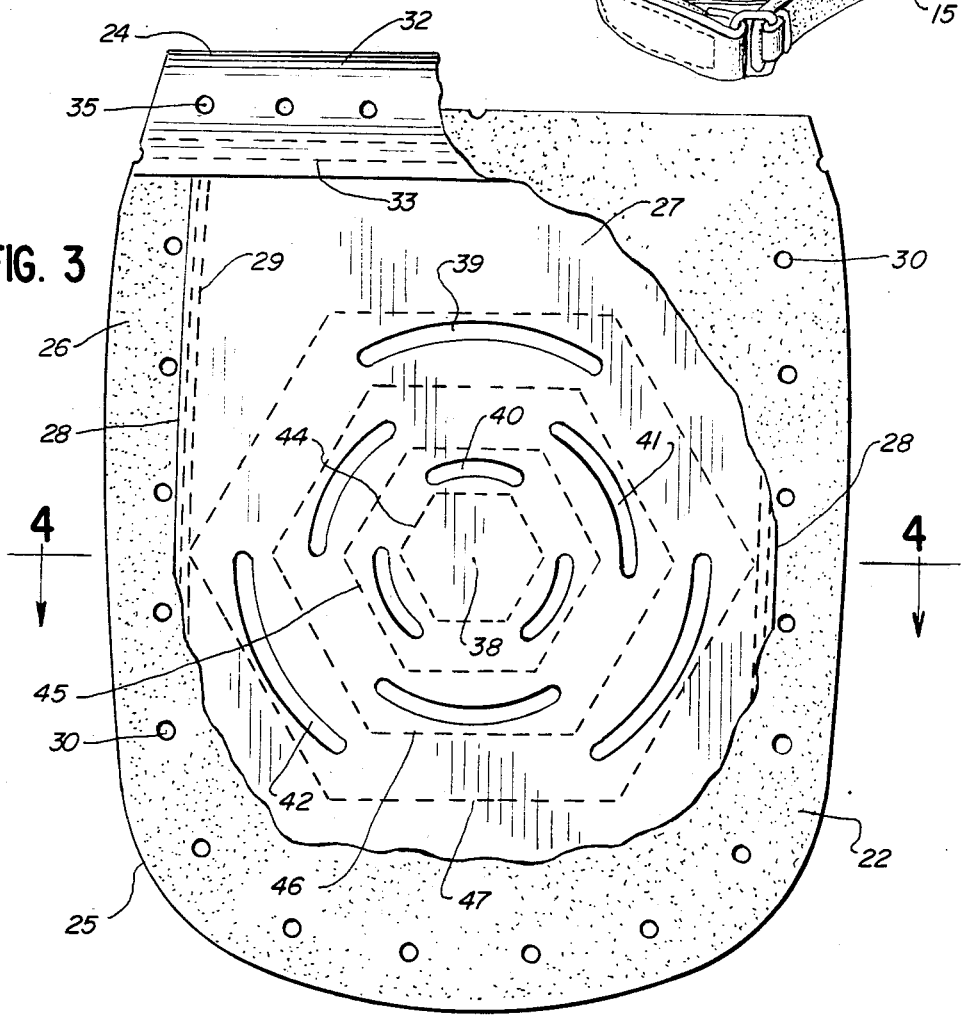
FIG. 3 is a plan view, partially broken away, of the web of FIG. 1.
Figure 4:
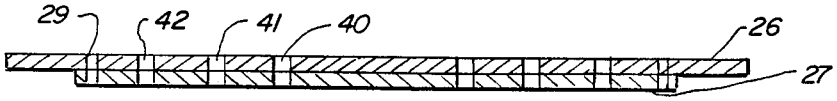
FIG. 4 is a sectional view taken along the line 4—4 of FIG. 3.

The web 21 is made of sheet material, for example, leather or imitation leather, and includes a relatively straight top edge 24 and a U-shaped edge 25 (FIG. 3). The particular web illustrated is formed from two layers 26 and 27 of sheet material (see FIGS. 3, 4, and 6). The outer layer 26 faces the back of the glove, and the U-shaped edge 28 of the inner layer terminates inwardly of the U-shaped edge 25 of the outer layer. The straight upper edges of the inner and outer layers overlap, and the layers are stitched together by a double row of stitching 29. Lacing holes 30 are provided around the periphery of the outer layer for the lacing 23 which attaches the web to the glove.

The upper edge of the web is provided by a U-shaped or looped piece 32 of sheet material which is stitched to the outside surfaces of the layers 26 and 27 by stitching 33. A double strand of lacing 34 (FIG. 6) extends through the center of the loop 32 and is secured to the thumb and finger stalls 21 and 17. Lacing holes 35 are provided in the loop 32 for lacing 36 (FIGS. 1 and 2) which is spirally wrapped around the top of the loop 32 and the lacing 34 inside of the loop. The lacing 36 also is attached to the thumb and finger stalls 21 and 17.

The manner of attaching the web to the glove by means of the lacing 23, 34, and 36 and the loop 32 is conventional and does not form part of this invention. The web can be attached in any other suitable manner.

Referring to FIG. 3, the web 22 has a central portion or focal portion 38 which is in the approximate center of the web when the web is attached to the glove. A plurality of slits 39 are formed in the two layers 26 and 27 of the web and are arranged about the focal point 38.

In the embodiment illustrated in FIG. 3 the slits extend in arcs around the focal portion, and the slits are arranged in three sets 40, 41, and 42. Each set includes three curved slits which have substantially the same radius from the focal point, and the radius of each set is different so that the slits of each set are spaced different distances from the focal point. The ends of the slits are rounded to inhibit propagation of cracks or tears in the web. The focal point 38 need not be an exact geometric center, and the centers of the arcs of the slits can be spaced apart somewhat as long as the slits are arranged generally about the central portion of the web.

The two layers 26 and 27 are stitched together by a plurality of sets of stitching 44, 45, 46, and 47. In the embodiment illustrated in FIG. 3, each set of stitching is in the form of a hexagon. The inner stitching 44 extends inside the inner set 40 of slits, the stitching 45 is positioned between the sets 40 and 41 of slits, the stitching 46 is positioned between the sets 41 and 42 of slits, and the stitching 47 is positioned outside of the outer set 42 of slits. The stitching could be in the form of other polygons or could be circular. The stitching reinforces the web between adjacent sets of slits and prevents propagation of tears from one set of slits to another set.

The slits of adjacent sets alternate so that the ends of the slits in one set do not substantially overlap the ends of the slits in adjacent sets. For example, the centers of the slits of the inner set 40 are located at approximately 12:00, 4:00, and 8:00, and the centers of the slits of the second set 41 are located at approximately 2:00, 6:00, and 10:00. Radii drawn from the focal point 38 to the ends of the slits of one set will intersect the slits of other sets substantially at the ends of the slits.

In the preferred method of making the web, the layers 26 and 27 are stitched together by the stitching 29 and the four hexagonal sets of stitching 44–47. Thereafter, the slits are punched in the web at the desired locations.

Figure 6:
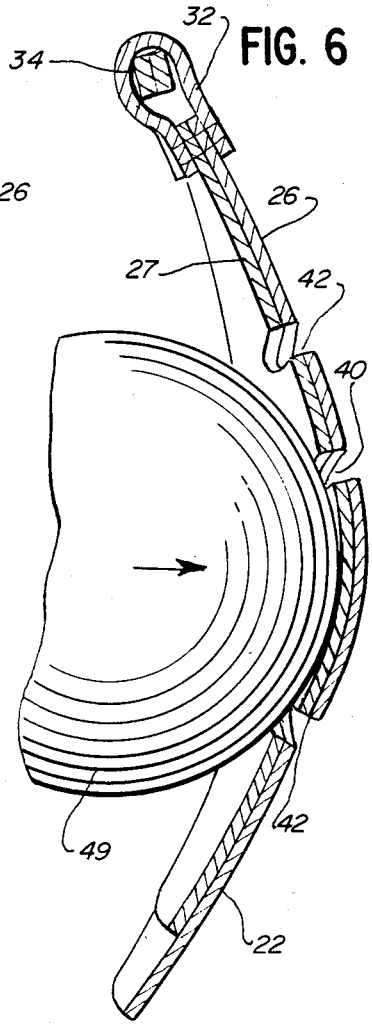
FIG. 6 is a sectional view taken along the line 6—6 of FIG. 5.
Figure 7:
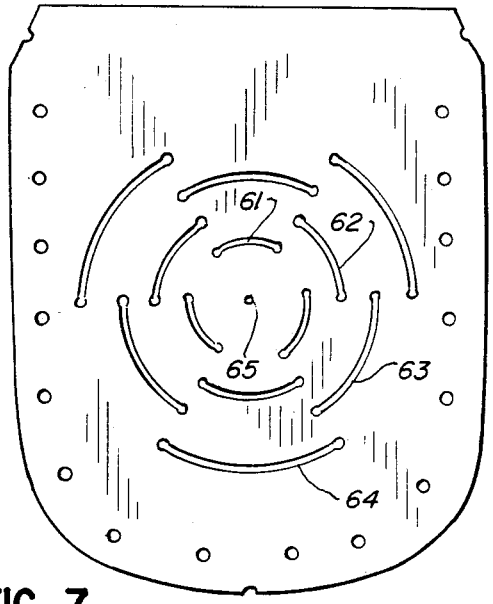

The slits render the web substantially more flexible and extensible or expandable and permit the web to form a natural pocket for a ball without a break-in period. FIG. 6 is a sectional view illustrating a ball 49 being caught in the web. FIG. 7 illustrates the web of FIG. 6 in the expanded condition with the ball being omitted for clarity of illustration.

Figure 5:
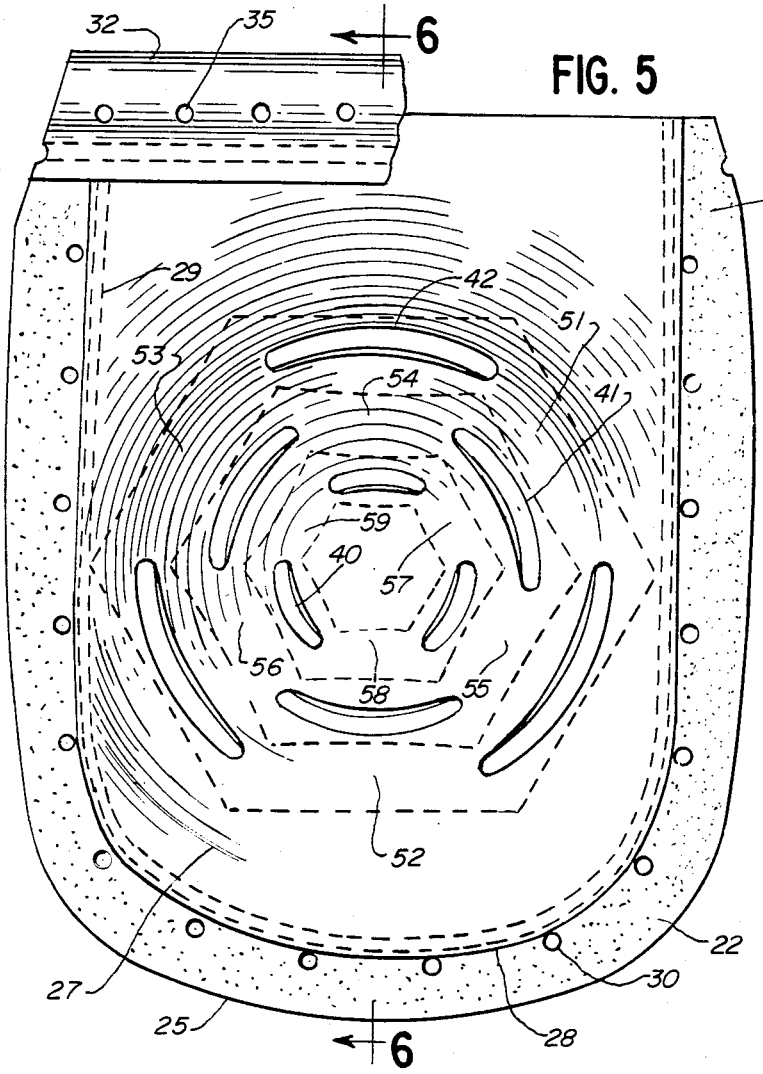
FIG. 5 is a plan view, partially broken away, showing the shape of the web when a ball is caught by the web, the ball being omitted for clarity of illustration.

When the ball strikes the web, each set of slits permits the portion of the web radially inwardly of the slits to extend in the direction in which the ball is moving to form a three-dimensional pocket. Referring to FIG. 5, the portion of the web inside of the outer slits 42 is attached to the portion of the web outside of the slits 42 by three relatively short segments 51, 52, and 53. The portions of the web along the inside edges of the slits 42 are free to be pulled inwardly and rearwardly by the ball away from the outside edges of the slits 42. Similarly, the portion of the web inside of the middle slits 41 is connected to the remainder of the web by three relatively short segments 54, 55, and 56, and the inside edges of the slits 41 can be pulled inwardly and rearwardly away from the outside edges of the slits 41 by the ball. The central portion of the web inside of the inner slits 42 is connected to the remainder of the web by short segments 57, 58, and 59, and the inside edges of the slits 40 can be pulled inwardly and rearwardly by the ball.

Even though the material of the web is relatively inelastic and even though the edges of the web are securely attached to the glove by the lacing, the web is highly flexible and expandable by virtue of the slits. When the ball is removed from the web, the web will return substantially to its initial configuration.

Although I have described the web as being formed from two layers of leather or leather-like material, it is also possible to use a single layer. The use of two layers of leather for a web is conventional, however, so that both outside surfaces of the web will have a finished appearance.

FIGS. 7 through 14 illustrate alternate embodiments of slit patterns for the web. In FIG. 7 four sets of curved slits 61, 62, 63, and 64 extend about a central hole 65. Each set contains three slits. FIG. 7 does not show stitching between the sets of slits, but this stitching can be added if desired to provide additional reinforcement for the web and to ensure against the possibility that a tear from a slit will propagate to the slit of an adjacent set.

Figure 8:
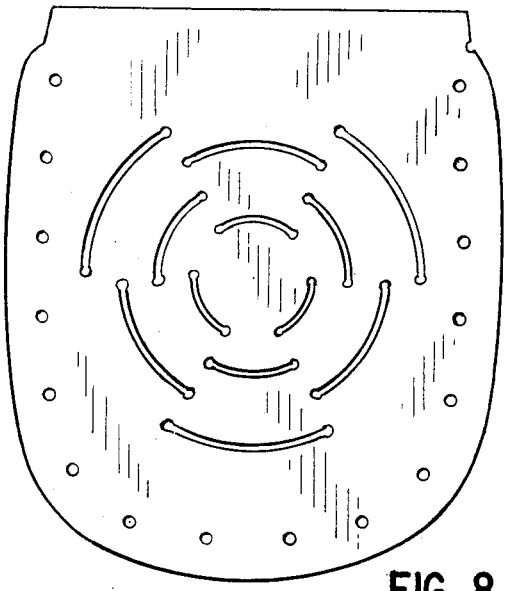

FIG. 8 is similar to FIG. 7, but an opening is not provided at the focal point.

In FIG. 9 an inner set of slits 67 is arranged about a focal point 68. The slits 67 are slightly curved, but the radius of curvature is substantially greater than the distance between the slits and the focal point 68 so that the slits are much straighter than the slits 61 of FIG. 7. Second and third sets of slits 69 and 70 are arranged around the first set. A fourth set of three outer slits 71 are located in the upper portion of the web, and the focal point of these outer slits is spaced above the focal point 68.

In FIG. 10 an inner set of four slits 73 is arranged about a central opening 74. Four other openings 75 are provided in the central portion of the web inside of the slits 73. Second and third sets of slits 76 and 77 are arranged around the focal point 74, and each set contains four slits. A fourth set of three outer slits 78 are located in the upper portion of the web.

The slit pattern of Fig. 11 is similar to the pattern of FIG. 9, but the curvature of the slits in FIG. 11 is greater than the curvature of the slits in FIG. 9.

Figure 12:
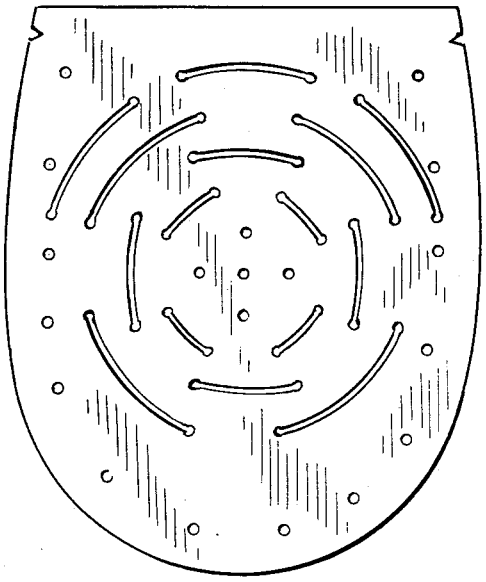

The slit pattern of FIG. 12 is similar to the slit pattern of FIG. 10, but the focal point of the pattern of FIG. 12 is closer to the upper edge of the web so that the outer set of slits is positioned closer to the upper edge of the web.

Figure 13:
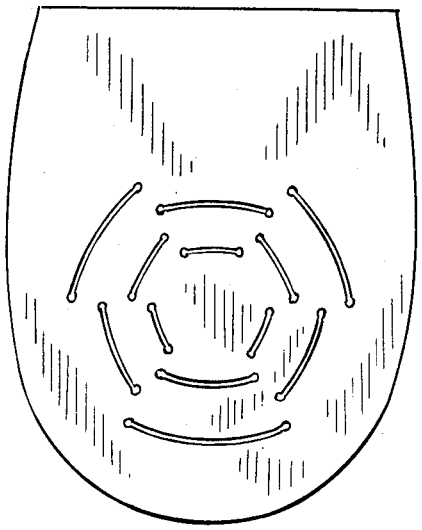

In FIG. 13 the focal point of the slits is positioned closer to the bottom of the web than the top edge, and the upper portion of the web includes a substantial area which is not provided with slits.

Figure 14:
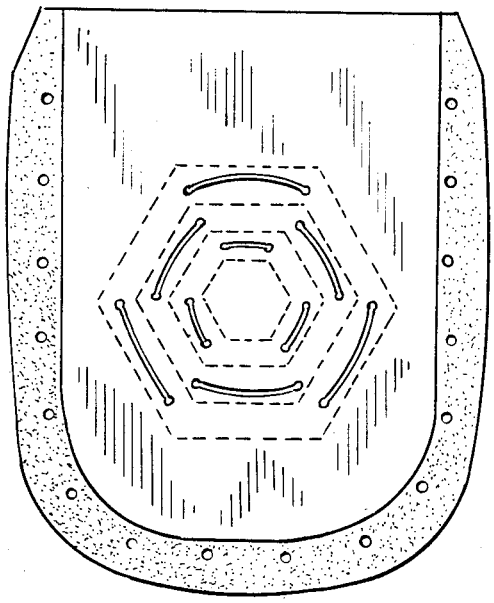

FIG. 14 illustrates a slit pattern similar to the slit pattern of FIG. 3. However, the radius of curvature of the slits of FIG. 14 is greater than the distance between the slits and the focal point so that the slits of FIG. 14 are substantially straighter than the slits of FIG. 3. FIG. 14 illustrates stitching between adjacent sets of slits, and similar stitching can be included on each of the webs illustrated in FIGS. 7–13.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A web for a ball glove comprising a sheet of glove material having a focal portion and a plurality of slits therein, the slits being arranged in a plurality of sets, the minimum distance between the focal portion and each slit of a particular set being approximately the same, said minimum distance being different for each set.

2. The web of claim 1 in which each slit extends in an arc about said focal point.

3. The web of claim 1 including stitching between each pair of adjacent sets of slits.

4. The web of claim 3 in which the stitching between each pair of adjacent sets of slits forms a polygon.

5. The web of claim 3 in which the stitching does not intersect any slits.

6. The web of claim 1 in which each set of slits includes three slits.

7. The web of claim 1 in which each end of each slit is rounded to resist propagation of tears from the slit.

8. The web of claim 1 in which the slits of each set do not substantially overlap slits of adjacent sets.

9. The web of claim 1 in which the slits of each set terminate approximately at radii which extend from the focal portion and the slits of each set do not substantially overlap slits of adjacent sets.

10. The web of claim 1 in which said sheet material is leather.

11. The web of claim 1 in which said sheet comprises two layers of leather stitched together.

12. The web of claim 1 in which the sheet of glove material is an integral, one-piece sheet and said slits are punched therein.

13. In a ball glove having a palm portion, a finger portion, and a thumb portion, a web extending between and attached to the finger portion and the thumb portion, the web comprising a sheet of glove material having a focal portion and a plurality of slits extending around the focal portion, the slits being arranged in a plurality of sets, the minimum distance between the focal portion and each slit of a particular set being approximately the same, said minimum distance being different for each set.

14. The glove of claim 13 in which each slit extends in an arc about said focal point.

15. The glove of claim 13 including stitching between each pair of adjacent sets of slits

16. The glove of claim 13 in which set of slits includes three slits.

17. The glove of claim 13 in which each end of each slit is rounded to resist propagation of tears from the slit.

18. The glove of claim 13 in which the slits of each set do not substantially overlap slits of adjacent sets.

19. The glove of claim 13 in which the slits of each set terminate approximately at radii which extend from the focal portion and the slits of each set do not substantially overlap slits of adjacent sets.

20. The web of claim 13 in which said sheet comprises two layers of leather stitched together.

21. The web of claim 13 in which the sheet of glove material is an integral, one-piece sheet and said slits are punched therein.

22. A web for a ball glove comprising an integral one-piece sheet of glove material having a central portion and a plurality of slits punched therein, the slits being arranged in a plurality of sets which extend generally arcuately around the central portion of the sheet, each set being spaced a different distance from the center of the sheet.

23. The web of claim 22 in which the web comprises a pair of integral, one-piece layers of leather which are stitched together.

24. In a ball glove having a palm portion, a finger portion, and a thumb portion, a web extending between the attached to the finger portion and a thumb portion, the web comprising an integral, one-piece sheet of glove material having a central portion and a plurality of slits punched therein, the slits being arranged in a plurality of sets which extend generally arcuately around the central portion of the sheet, each set being spaced a different distance from the central portion of the sheet.

25. The glove of claim 24 in which the web comprises a pair of integral, one-piece layers of leather which are stitched together.

* * * * *

UNITED STATES PATENT AND TRADEMARK OFFICE

CERTIFICATE OF CORRECTION

PATENT NO. : 4,541,126

DATED : September 17, 1985

INVENTOR(S) : John R. Howard et al

It is certified that error appears in the above-identified patent and that said Letters Patent is hereby corrected as shown below:

Col. 6, line 13 change the first occurrence of "the" to --and--.

Signed and Sealed this

Tenth Day of December 1985

[SEAL]

*Attest:*

DONALD J. QUIGG

*Attesting Officer*

*Commissioner of Patents and Trademarks*